US005845169A

United States Patent [19]

Patton et al.

[11] Patent Number: 5,845,169

[45] Date of Patent: Dec. 1, 1998

[54] PHOTOGRAPHIC PROCESSOR

[75] Inventors: David L. Patton, Webster; John H. Rosenburgh, Hilton, both of N.Y.

[73] Assignee: Eastman Kodak Company, Rochester, N.Y.

[21] Appl. No.: 839,282

[22] Filed: Apr. 17, 1997

[51] Int. Cl.[6] ..... G03D 3/02; G03D 3/08; G03D 13/00

[52] U.S. Cl. ..... 396/564; 396/572; 396/612; 396/627

[58] Field of Search ..... 396/612, 620, 396/626, 627, 636, 564; 430/30, 398–400

[56] References Cited

U.S. PATENT DOCUMENTS

| | | | |
|---|---|---|---|
| 3,585,917 | 6/1971 | Griffith | 396/661 |
| 3,709,472 | 1/1973 | Kreitz et al. | 396/571 |
| 3,826,896 | 7/1974 | Thompson | 396/571 |
| 4,047,213 | 9/1977 | Land | 396/575 |
| 4,198,145 | 4/1980 | Scott | 396/564 |
| 4,275,959 | 6/1981 | Jones | 396/612 |
| 4,293,212 | 10/1981 | Siryj et al. | 396/575 |
| 4,322,158 | 3/1982 | Frias et al. | 355/27 |
| 4,653,890 | 3/1987 | Nordstrom et al. | 396/649 |
| 4,737,810 | 4/1988 | Kobayashi et al. | 396/627 |
| 4,841,320 | 6/1989 | Takekoshi et al. | 396/627 |
| 5,148,206 | 9/1992 | Shidara | 396/622 |
| 5,270,762 | 12/1993 | Rosenburgh et al. | 396/632 |
| 5,302,993 | 4/1994 | Farling et al. | 396/626 |
| 5,307,109 | 4/1994 | Miyasaki et al. | 396/626 |
| 5,355,190 | 10/1994 | Rosenburgh et al. | 396/626 |
| 5,398,094 | 3/1995 | Rosenburgh et al. | 396/632 |
| 5,418,591 | 5/1995 | Rosenburgh et al. | 396/632 |
| 5,418,592 | 5/1995 | Patton et al. | 396/626 |
| 5,420,659 | 5/1995 | Manico et al. | 396/619 |
| 5,432,581 | 7/1995 | Patton et al. | 396/636 |
| 5,432,591 | 7/1995 | Geleynse | 399/249 |
| 5,502,532 | 3/1996 | Biesinger et al. | 396/575 |

*Primary Examiner*—D. Rutledge
*Attorney, Agent, or Firm*—Frank Pincelli

[57] ABSTRACT

A method and apparatus for processing a photosensitive material through at least one processing solution for processing of a photosensitive material. The apparatus includes a transport mechanism for providing moving of the photosensitive material through the processor. A heater is provided in the processing tank for localized heating of the photosensitive material passing through the processing solution.

29 Claims, 8 Drawing Sheets

PHOTOGRAPHIC PROCESSOR

FIELD OF THE INVENTION

The present invention relates to the field of photography, and more particularly, to the method and apparatus for processing photosensitive material.

BACKGROUND OF THE INVENTION

The processing of photosensitive material involves a series of steps when the photosensitive material is subjected to various different processing solutions. Typically, in a photographic processor, photosensitive material will be subjected to developing, bleaching, fixing, and washing solutions. Thereafter, the photosensitive material is subjected to a drying operation before leaving the apparatus. During each of the steps wherein the photosensitive material is subjected to a processing solution, it is critical that the temperature of the processed solution be held within parameters, and that fresh solution be brought to the surface of the photosensitive material so that the appropriate chemical reaction between the processing solution and the photosensitive material can take place. In prior art processors, the temperature of the processing solution is maintained by the use of heaters which heat the processing solution to a specified temperature and maintains the processing solution at the specified temperature within certain tolerances through the use of a temperature controller. In prior art processors, it is also known to utilize agitation of a processing solution next to the emulsion surface of the photosensitive material so as to provide fresh solution at the surface. This may be accomplished through the use of rollers, wiper blades, or impinging of the processing solution against the photosensitive material. In order to reduce the time required for processing the photosensitive material, processing parameters may be varied. These include the concentration and make-up of the processing solution themselves, the amount of agitation used to apply the solution of photosensitive material, and the temperature of the solution.

The changing of the constituents of the processing solution is difficult because most photographic processors must be able to successfully process photosensitive material from several different manufacturers with extremely reliable, repeatable results. Change in the make-up of the processing solution can introduce significant effects on the different manufacturing products introduced therein.

By using high impingement agitation, such as disclosed in U.S. Pat. Nos. 5,270,762; 5,355,190; and 5,398,094, the time required for each processing solution can be reduced, but only to a point, since the chemical reaction required becomes limited by the diffusion rate of the solution through the gelatin emulsion of the photosensitive material. As soon as the method of agitation used reaches a certain level of supplying fresh solution to the photosensitive material surface, further improvement in this area becomes difficult, if at all possible, upon further agitation.

An effective way to shorten a photographic process time is to increase the temperature of processing solution through which the photosensitive material passes. However, increasing the temperature causes a chemical reaction to occur at an accelerated rate. The problem with increasing the temperature of the solution is that the processed solution may oxidize and generally decompose at a much faster rate. Additionally, the higher temperatures increase the rate of evaporation of processing solution. Further, when higher temperatures are used, greater care must be taken with the processing solution to prevent operators from getting burned, or being subjected to chemical vapors that are outgassed because of the higher temperatures. Furthermore, increased wear and tear occurs on the processing equipment due to the increase in the differential in temperature the equipment experiences between time when the device is in use and when the processor is not in use. All of the foregoing factors require increased cost of running the equipment.

It has been suggested in the prior art that in order to increase faster processing time, the photosensitive material be preheated before entering the processor. While this has been found to find a slight increase in efficiency and use of the solution and improvement in processing time, the down side is that the heat added by the preheated photosensitive material also brings additional problems associated with increased processing solution temperatures as previously discussed. Another problem with preheating of photosensitive material is that all the layers of the emulsion of the photosensitive material have the same temperature. As the processing solution diffuses in the various emulsion layers, the increase in chemical reaction is the same for the top layer, as well as the layers closest to the base.

SUMMARY OF THE INVENTION

An object of the present invention is to overcome the above problems experienced by processors by selectively raising the temperature of the photosensitive material after it has entered the processing solution and that the overall temperature of the processed solution is not increased. This is accomplished by applying heat directly to a very small area of the film in an area where fresh processing solution has broadened the contact with the surface of the photosensitive material.

An apparatus made in accordance with the present invention reduces the processing cycle time by incorporating a heater for localized heating of the film so as to increase the chemical reactivity of the photographic emulsions at the point of heating.

Localized heating of the photosensitive material through the base creates a temperature gradient through the emulsion layer. The resulting temperature gradient results in the emulsion layer being closer to the base so layers closer to the processing solution are the coolest. This results in the emulsion layers, which are first subjected to processing solution, having a slower reaction because they are at a lower temperature, while the layers that see the solution later have a faster reaction because they are at the higher temperature. The overall net result is more efficient use of the processing solution and faster processing time without having to raise the overall processing solution temperatures within the processing tank.

The resulting temperature gradient provided by an apparatus according to the present invention allows the photosensitive film designer more latitude where they can place the various light-sensitive emulsion. Presently, emulsions that react slower to processing solution must be located closer to the photosensitive material surface and faster reaction layers are placed closer to the base. This arrangement does not always correspond to the optimal placing of emulsion layers for the capturing of light in the resulting layer and interactions and image sharpness. The overall result is usually a compromise that causes longer processing time, need for higher concentration of solutions, or inefficient use of processing solution.

In accordance with one aspect of the present invention, there is provided a photographic processor for developing of photosensitive material. The processor comprises a processing tank containing processing solution for processing of a photosensitive material. A transport mechanism is provided for moving of the photosensitive material through the processor. A heater is provided in the processing tank for localized heating of the photosensitive material passing through the processing solution.

In accordance with another aspect of the present invention, there is provided a method of processing photosensitive material by passing the photosensitive material through a processing tank containing a processing solution. The method comprises the steps of:

a) moving of photosensitive material through the processing solution; and b) localized heating of the photosensitive material as it passes through the processing solution so as to improve the chemical activity of the emulsions layers contained in the photosensitive material.

BRIEF DESCRIPTION OF THE DRAWINGS

Other objects, advantages and features of the present invention will become apparent from the following specification when taken in conjunction with the drawings in which like elements are commonly enumerated and in which.

DETAILED DESCRIPTION OF THE INVENTION

Figure 1:
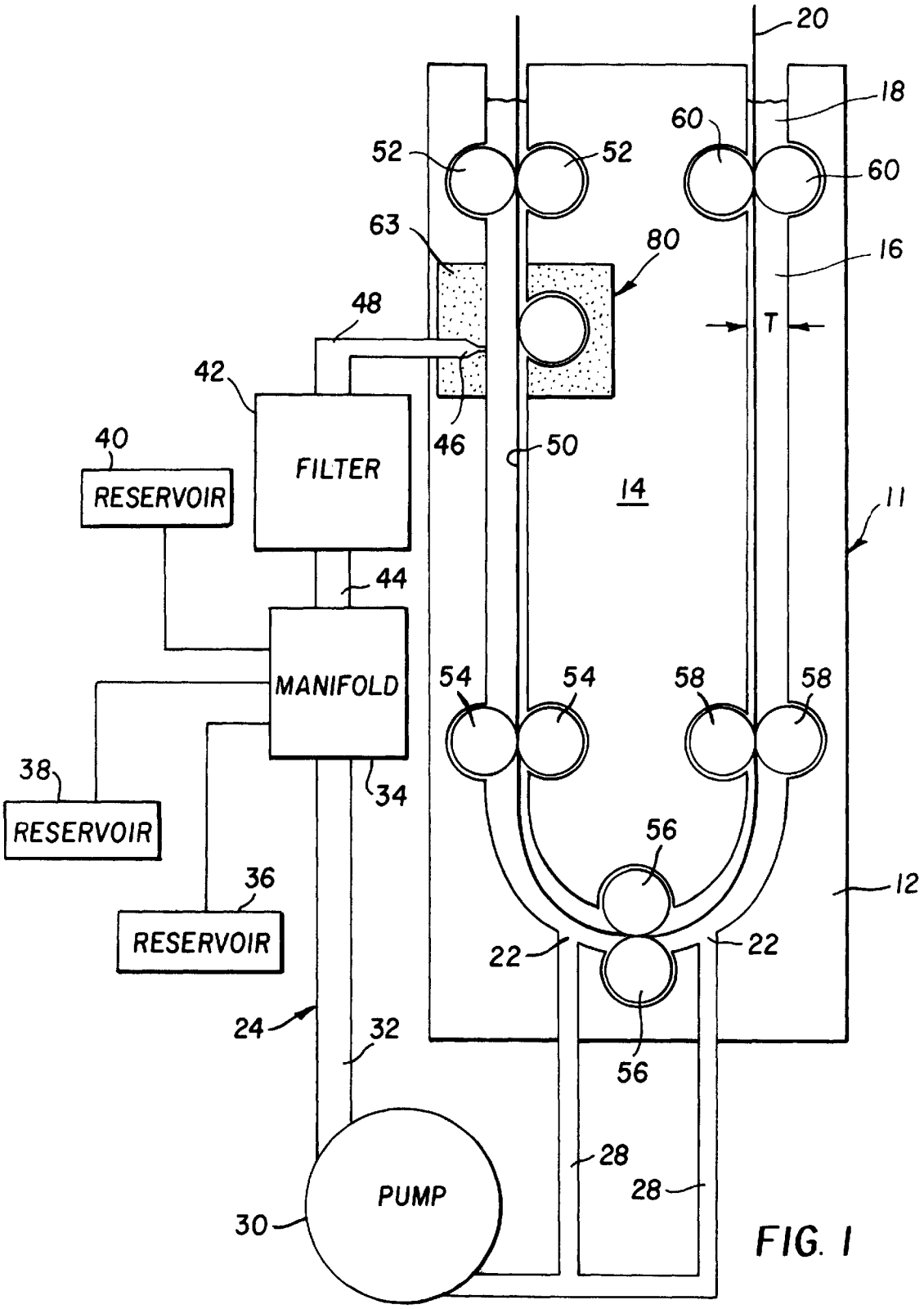
FIG. 1 is a schematic drawing of an apparatus made in accordance with the present invention.

Referring to FIG. 1, there is illustrated in schematic form, an apparatus 10 made in accordance with the present invention. The apparatus 10 includes at least one processing section 11. In the embodiment illustrated, the processing section 11 comprises a processing tank 12 and rack 14 for placement in the tank 12. In the preferred embodiment illustrated, the processing section 11 is of the low volume thin tank type construction. Thus, the rack 14 and tank 12 are constructed so as to form a narrow processing channel 16 for containing a processing solution 18 through which a photosensitive material 20 passes for processing. The processing channel 16 includes a pair of outlets 22 for allowing processing solution to go through the recirculation system 24 and then return to the processing channel 16. In particular, the recirculation system 24 includes conduits 28 for fluidly connecting the outlets 22 of the processing channel 16 to a recirculation pump 30, which recirculates the processing solution 18 through the recirculation system 24. A conduit 32 is provided for directing processing solution 18 through a manifold 34 from recirculation pump 30. The manifold 34 is provided for introducing replenishment solution contained in reservoirs 36, 38, 40 which are introduced to the manifold 34 by pumps, not shown. The manifold 34 is fluidly connected to a filter 42 by conduit 44. The filter 42 is connected to inlet nozzle 46 by conduit 48. The inlet nozzle 46 is designed for introducing processing solution 18 against the top surface 50 of the emulsion side of the photosensitive material 20. A plurality of roller pairs 52, 54, 56, 58, 60 are provided for transporting and guiding the photosensitive material 20 through the processing channel 16. It is to be understood that any desired means may be used for transporting the photosensitive material 20 through the processor and that the photosensitive material may be of the continuous web or sheet form. A computer, not shown, is provided for controlling operation of the apparatus 10 as is conventionally done and, therefore, will not be discussed in any detail herein.

In FIG. 1, only one processing section 11 is illustrated for containing a single processing solution for processing of the photosensitive material 20. It is to be understood that any desired number of processing sections 11 may be provided with each processing section containing any desired processing solution. The processing sections would serially subject the photosensitive material as is typically done in the prior art.

Figure 2:
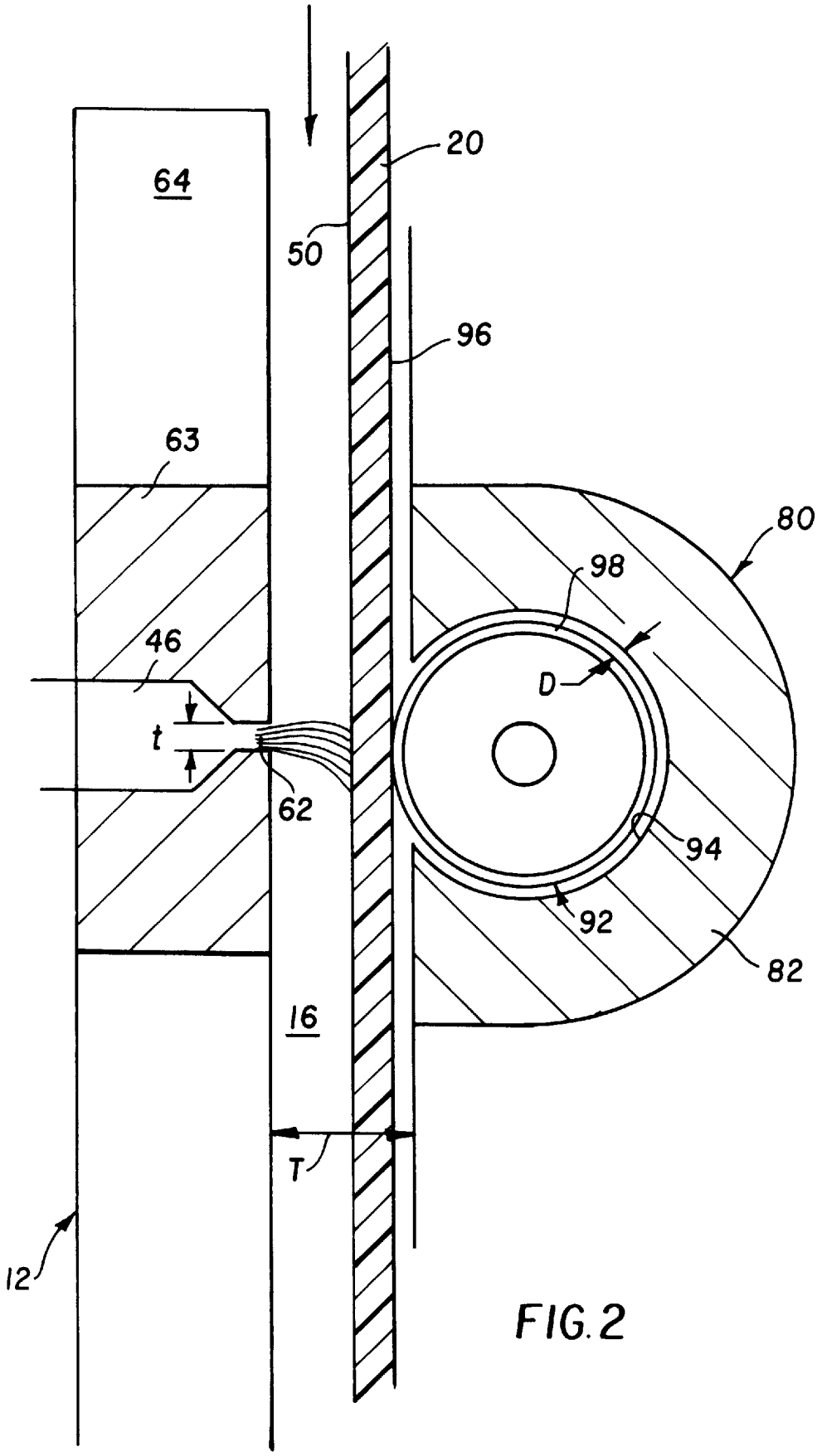
FIG. 2 is an enlarged cross-sectional view of a portion of FIG. 1 illustrating the processing solution being impinged upon the photosensitive material passing therethrough and being heated by a heater in accordance with one aspect of the present invention.

Referring to FIG. 2, there is illustrated in greater detail a portion of the processing tank 12 made in accordance with the present invention. In particular, there is illustrated nozzle 46 which has a nozzle opening 62 which has a thickness T. The nozzle 46 is preferably disposed in an insulating jacket 63 provided in wall 64 of tank 12. The jacket 63 is made of low thermal conductive material, such as polystyrene, polypropylene and polyethylene, so as to minimize heat transfer to the processing solution 18 passing therethrough. Alternatively, or in addition, an air gap may be provided around nozzle 46. The opening 62 is in the form of an elongated slot which extends at least along the width of the photosensitive material 20 passing adjacent thereto. As previously discussed, a narrow processing channel 16 is provided such that the opening 62 is disposed closely adjacent the surface 50 of the photosensitive material 20. For the purposes of the present invention, a narrow processing channel 16 shall be considered a channel having a thickness T equal to or less than 100 times the thickness of photosensitive material. Preferably, processing channel 16 has a thickness T equal to or less than 50 times the photosensitive material when photographic paper is used, most preferably a thickness T equal to or less than about 10 times the thickness of the photographic paper. In a processor for processing photographic film, the thickness T is most preferably equal to or less than about 18 times the thickness of the film.

An example of a processor made in accordance with the present invention for processing photosensitive paper, the paper having a thickness of about 0.008 inches, would have a processing channel 16 having a thickness T of about 0.080 inches, and a processor for processing photographic film, the film having a thickness of 0.0055 inches, would have a channel 16 having a thickness T of about 0.1 inches. However, it is to be understood that the thickness of the channel 16 may be varied as appropriate.

In order to provide efficient flow of the processed solution through the nozzle 46 into the processing channel 16, it is desirable that the nozzle opening 62 deliver processing solution to the processing channel in accordance with the following relationship:

$$1>F/A>40$$

wherein:

F is the flow rate of the processing solution through the nozzle in gallons per minute; and A is the cross-sectional area of the nozzle provided in square inches.

Providing a nozzle in accordance with the foregoing relationship assures appropriate discharge of the processed solution against the photosensitive material so as to provide an impinging force for introducing new processing solution to the surface of the photosensitive material.

As previously discussed, the present invention is designed to provide localized heating of the photosensitive material 20 as it passes through the processing channel 16. In the particular embodiment illustrated, there is provided a heater 80, which is provided in rack 14. In the particular embodiment illustrated, the heater 80 comprises a first insulating block 82 made of a material having a low thermal conductivity and includes an elongated roller 92 disposed in a substantially circular cavity 94 formed therein. The insulating material may be of any desired low thermal conductive material, such as polystyrene, polypropylene and polyethylene. Alternatively, or in addition, an air gap may be provided around the heater 80. As can be seen, the cavity 94 closely conforms to the outer configuration roller 92, leaving only a small distance therebetween. Preferably, the distance D is sufficient to allow easy rotation of the roller 92 therein. As illustrated, only a small portion of the roller 92 is allowed to come in contact with the back side 96 of the photosensitive material 20. The roller 92 is of the conductive type which allows heat to flow from roller 92 against the back surface 96 of the photosensitive material 20. It is to be understood that roller 92 may be heated by any desired technique. In the particular embodiment illustrated, the roller 92 has an outer shell section 98 made of an appropriate conductive material and is heated by appropriate electrical wires, not shown, connected thereto. The shell construction minimizes the thermal mask of the roller 92, thereby allowing easy adjustment of the temperature such that the appropriate amount of heat transfer occurs between the photosensitive material 20 and the roller 92. As can be seen, the heater 80 is positioned in direct opposition to the inlet nozzle 46. This is done so that the photographic processing solution 18 will cause the photosensitive material 20 to be pushed into intimate and continuous contact with the heat transfer roller 92. In addition, this provides heat at the exact area in which there is a high degree of agitation and new fresh processing solution being brought to the emulsion surface of the photosensitive material 20.

Figure 3:
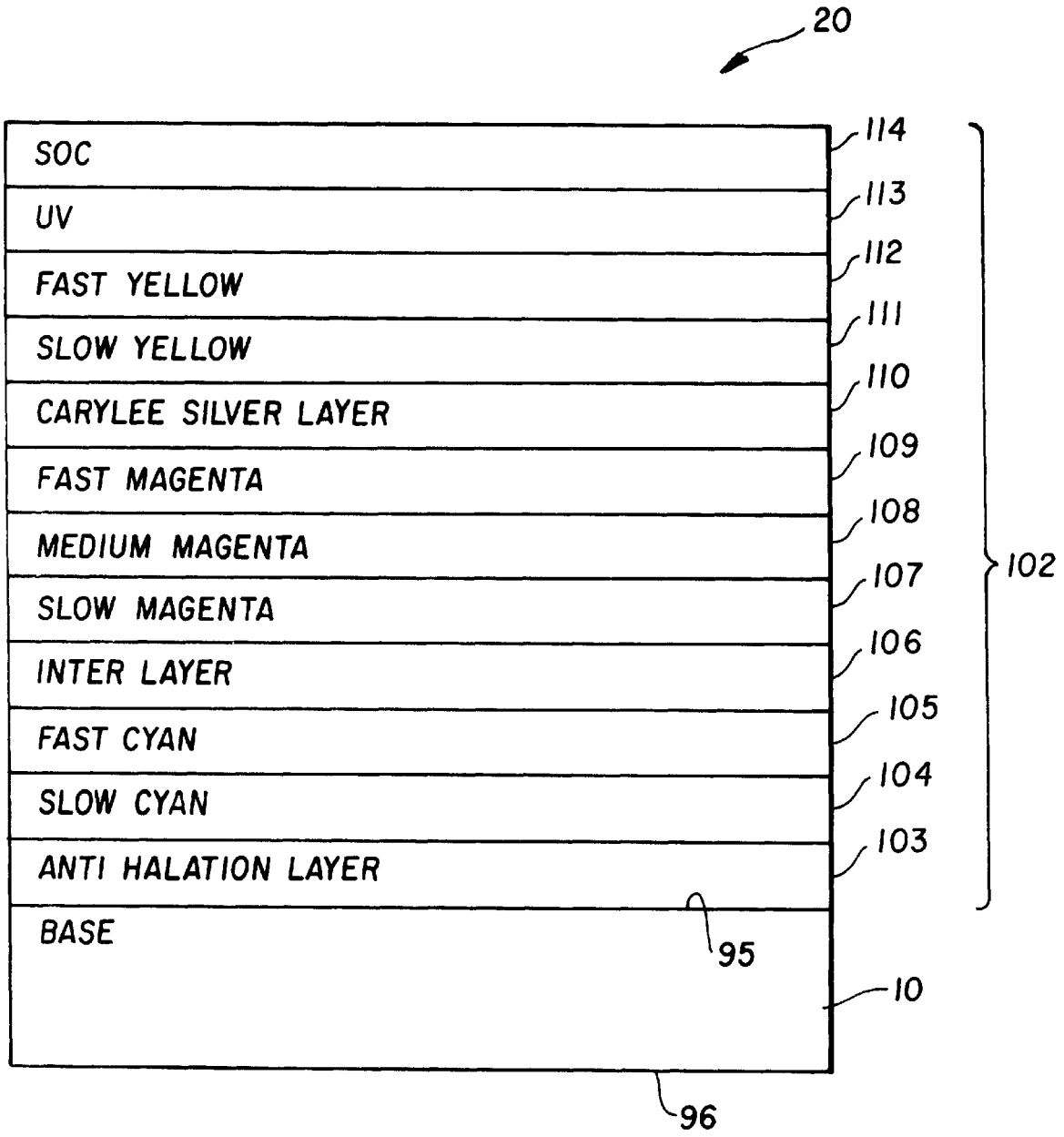
FIG. 3 is schematic diagram of the photosensitive material of FIG. 2.

Referring to FIG. 3, there is illustrated a schematic diagram of photosensitive material 20. In particular, photosensitive material 20 comprises a support base 100 having top surface 95 on which an emulsion layer 102 is provided. As can be seen, the emulsion layer 102 comprises a plurality of separate layers 103, 104, 105, 106, 107, 108, 109, 110, 111, 112, 113, 114. These layers serve to provide color to the photosensitive material, control processing and protection against ultraviolet light and physical abrasion. The operation and description of these layers is well known to those skilled in the art. A detailed description of these and similar type photosensitive material structures may be found in an article in Research Disclosure, September 1996, No. 389, Item 38957, entitled "Photographic Silver Halide Emulsions, Preparations, Addenda, Systems and Processing", published by Kenneth Mason Publications, Limited, Dudley Annex, 12a North Street, Emsworth, Hampshire P010 7DQ, England, which is hereby incorporated by reference in its entirety.

Figure 4A:
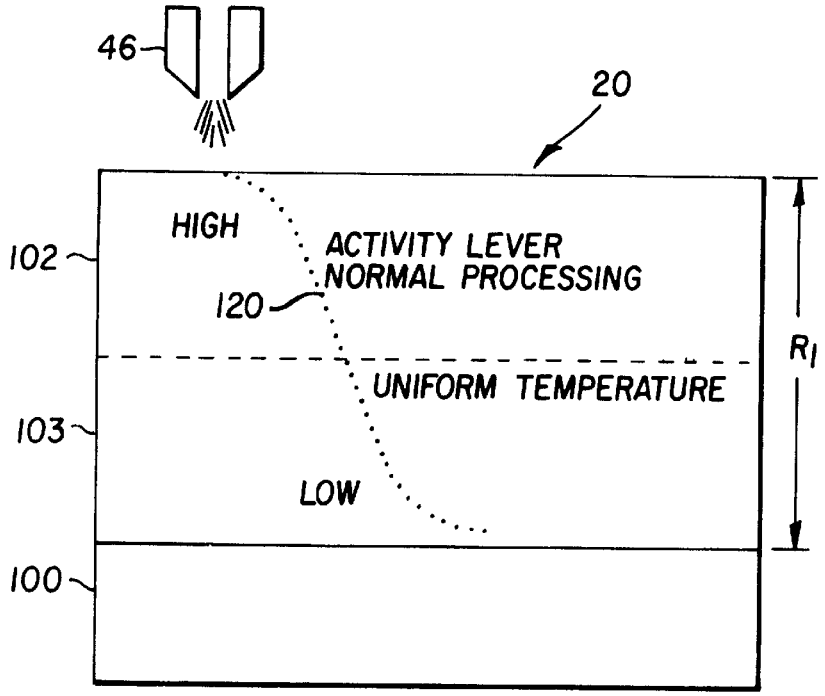
FIG. 4A, 4B is a greatly enlarged view of a photosensitive material being processed by the apparatus of FIG. 1 illustrating the chemical reactivity and temperature gradient of the emulsion layer as a function across its width.

Referring to FIG. 4A, there is illustrated in graphical form, the chemical reactivity of the emulsion layer with respect to its distance from the surface of the emulsion layer 102 as illustrated by line 120, for a processor made in accordance with the prior art wherein the photosensitive material experiences a substantially uniform temperature across the width W of the photosensitive material. As can be seen, the chemical reactivity is greatest at the surface of the photosensitive material closest to nozzle 46 and the lowest at layer 103 of the emulsion layer 102 adjacent the support base 100. The variation in the range of chemical reactivity is illustrated by R1.

Figure 4B:
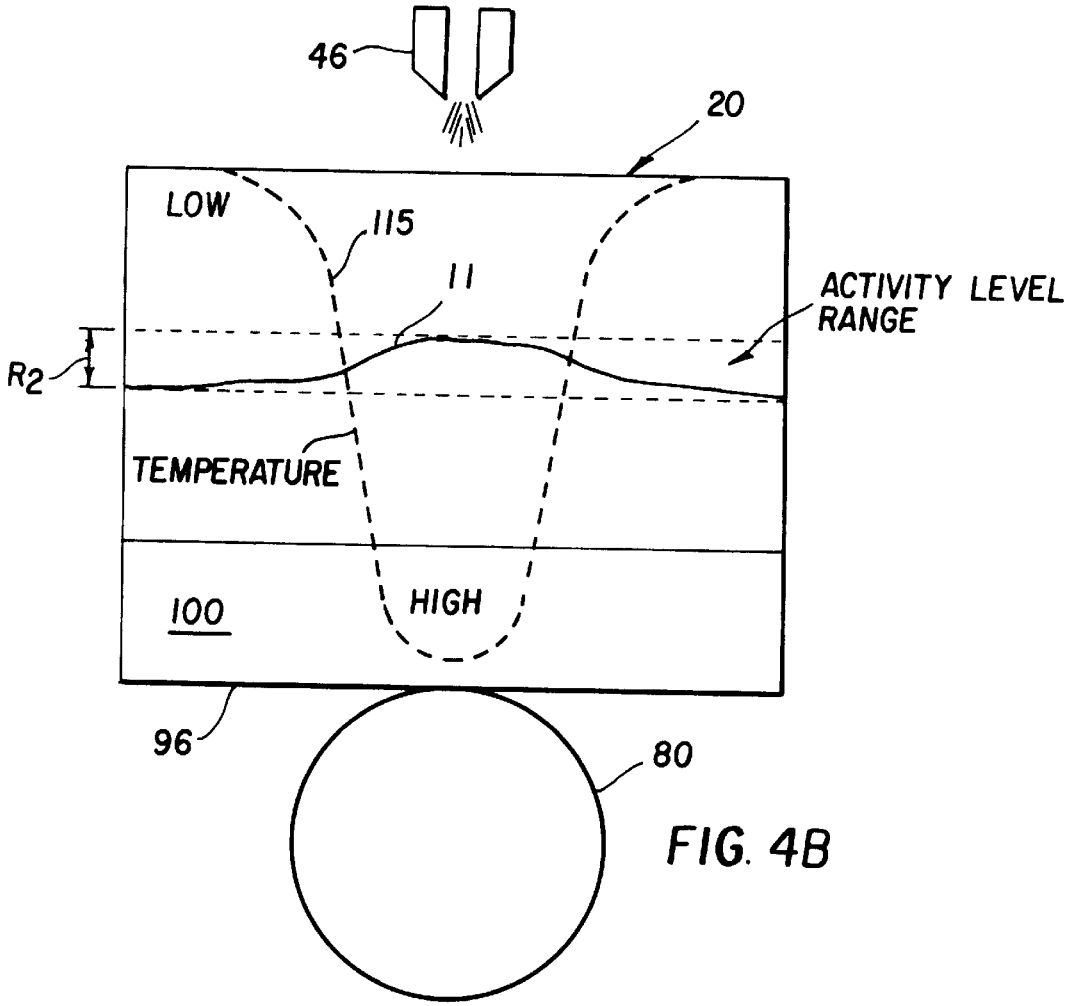

Referring to FIG. 4B, there is illustrated a graph of the type illustrated in FIG. 4A for an apparatus made in accordance with the present invention. A heating roller is used to heat the back side of the support layer 100 of the photosensitive material 20. The chemical reactivity of the emulsion layer 102 is illustrated by line 122. The temperature of the emulsion layer increases the closer it is to the heater 80 as illustrated by line 115. The area of the emulsion layers closest to the base 100 experience the greatest temperature, however, receive the least chemical reactivity due to the impinging processing solution. The variation of chemical reactivity R2 is substantially less than the range of variation R1 of the apparatus of FIG. 4A. Thus, the present invention provides a compensating effect in that the emulsion layer receiving the least chemical reactivity experiences the greatest temperature, therefore, providing a more uniform overall chemical reactivity for all of the emulsion layers.

The foregoing allows the photosensitive manufacturer more latitude in designing and constructing emulsion layers for photosensitive material. Instead of providing reactivity slower layers adjacent the top surface and requiring faster reactive emulsion layers to be placed closer to the base, greater latitude in designing desired emulsions layers to improve in the efficiency of processing, quality, or providing particular artistic effect, can more easily be achieved.

Figure 5:
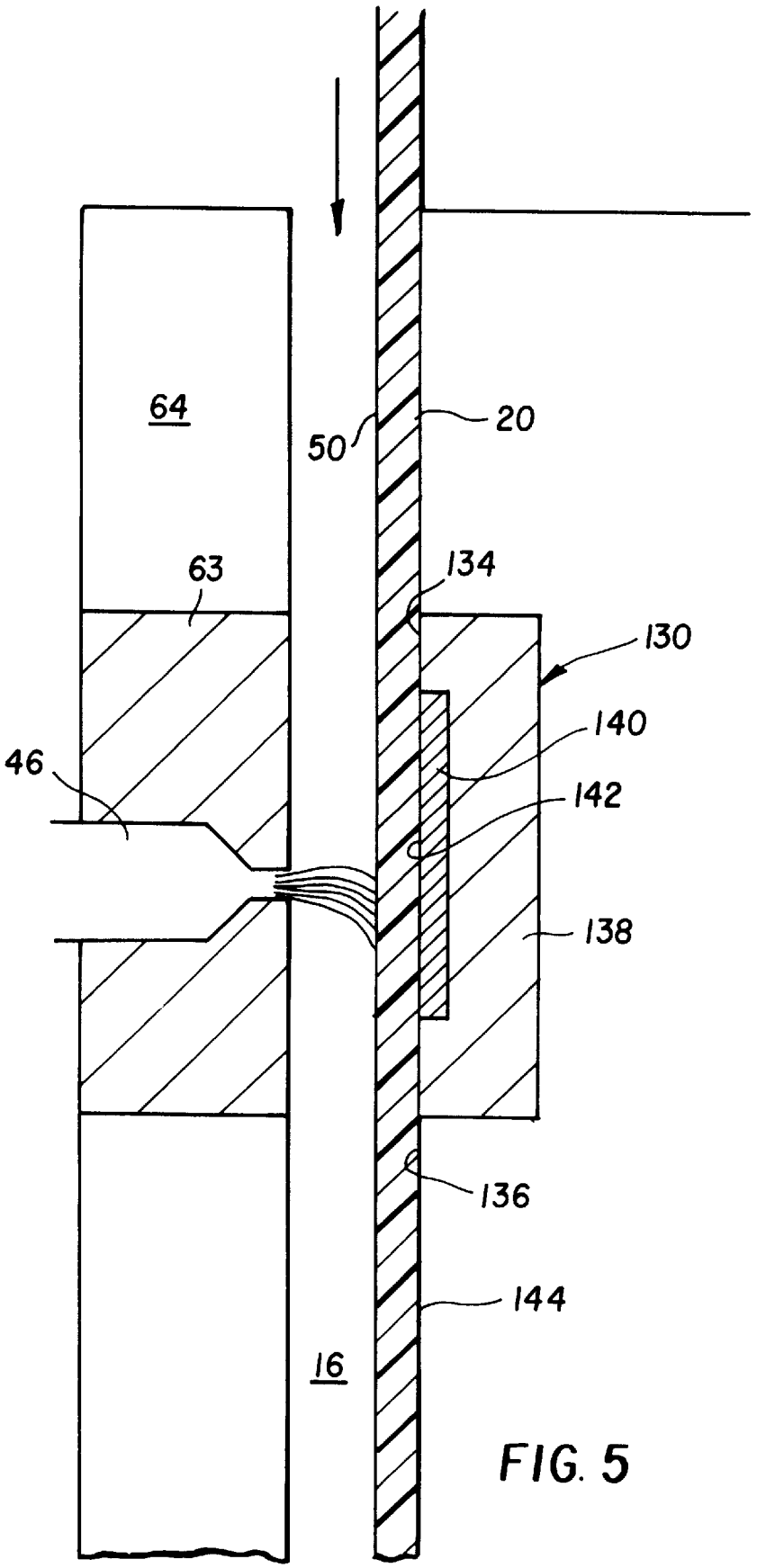
FIG. 5 is a view similar to FIG. 2 illustrating a modified heater for the localized heating of the photosensitive material passing therethrough.

Referring to FIG. 5, there is illustrated a partial view of a modified apparatus similar to FIG. 2 illustrating a modified heater 130 made in accordance with the present invention, like numerals indicating like parts and operation as previously discussed. In particular, there is illustrated a heater 130 embedded into the rack 14, such that the surface 134 of the heater is substantially planar and substantially flush with the surface 136 of the rack 14. The heater 130 comprises a mounting body section 138, which is mounted in rack 14, and is made out of an insulating material. Disposed at the outer surface, and within the body section 138, there is provided a heat-conductive element 140 having an outer engaging surface 142, which is also coplanar with the surface 136 of the rack 14. The surface 142 is designed to engage the back surface 144 of the photosensitive material as illustrated. The heating element 140 is positioned to be substantially opposite the nozzle 46 such that the nozzle 46 will force the photosensitive material 20 against the heating element 140, thus encouraging the heat transfer from the heating element 140 to the photosensitive material 20. In this embodiment, the back surface 144 of the photosensitive material 20 slides against the surface 142. Therefore, the surface 142 is appropriately made as smooth as possible to avoid any unnecessary abrasive scratching to the surface of the photosensitive material.

Figure 6:
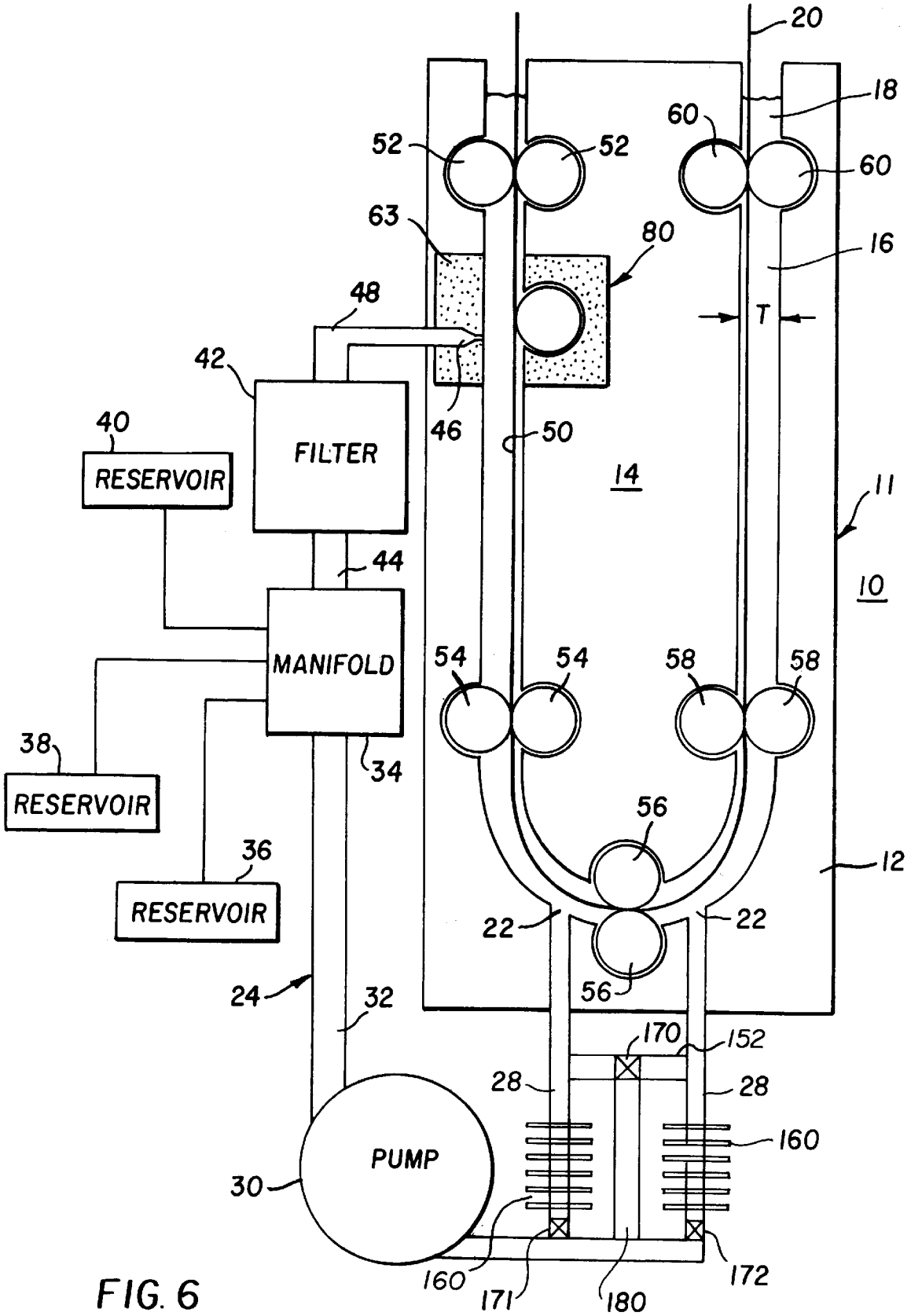
FIG. 6 is a schematic view of a view similar to FIG. 1 illustrating a modified processing section made in according to the present invention.

Referring to FIG. 6, there is illustrated in modified form an apparatus 10 made according to the present invention, like numerals indicating like parts and operation as previously discussed. In this embodiment, a pair of cooling coils 160 are provided in conduits 28 for cooling of a processing solution in the recirculation system 24 prior to reaching the pump 30. This is particularly important in a low volume thin tank type processor where a minimum amount of volume is provided, both in the processing channel and in the recirculatory system. This avoids the possibility of the overall temperature of the processing solution from increasing to an undesirable level. In the embodiment illustrated, a cross-conduit 152 connects the two conduits 28. A valve 170 is provided in conduit 152 where another conduit 180 is provided for providing fluid connection with section 155 of conduits 28 at a point after cooling coils 160. Valve 171, 172 are provided after each of the cooling coils 160 in conduits 28. When valve 170 is in the closed state and valves 171, 172 are in the open state, processing solution will be cooled by cooling coils 160. When valve 170 is in the open state and valves 156 are in the open state, there is no cooling of the processing solution. By controlling valves 170, 171, 172 cooling of the processing solution may be turned on and off as required for proper operation of the apparatus. Appropriate controls and sensors are provided in the apparatus for sensing when cooling of the processing solution is required and for turning on and off valves 170, 171, 172 as is conventionally employed for such purposes, for example, computer and temperature sensors. The employment and operation of such devices are well known to those of ordinary skill in the art.

Figure 7:
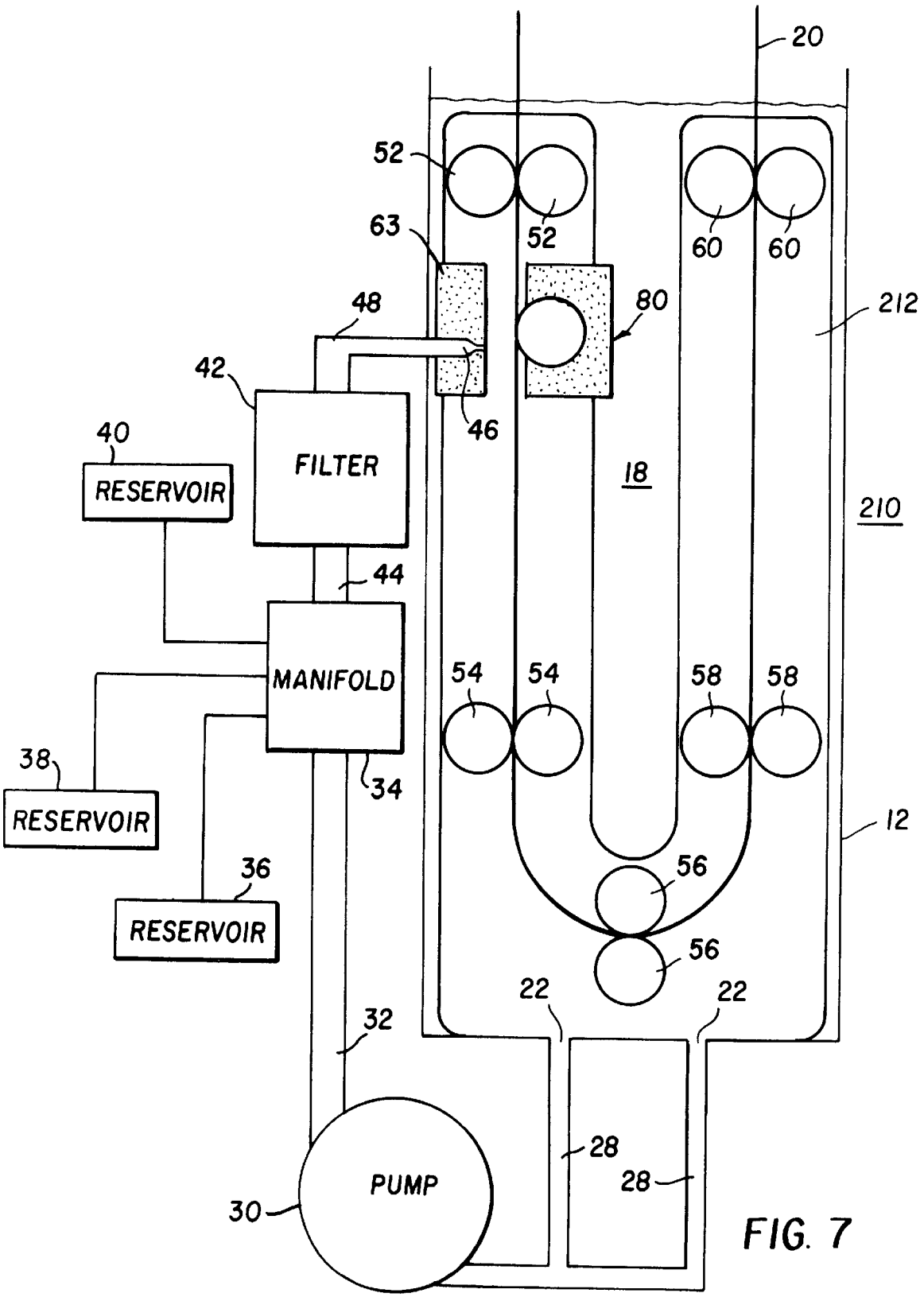
FIG. 7 is a schematic view similar to FIG. 1 illustrating another modified rack and tank made in accordance with the present invention.

While in the preferred embodiment, the processing tank is of a low volume thin tank type. It is to be understood that the present invention may be applied to other type construction. Referring to FIG. 7, there is illustrated a modified apparatus 210 made in accordance with the present invention, like numerals indicating like parts and operation as previously discussed. In this embodiment, the tank 12 contains processing solution and a typical rack 212 is provided within the tank 12 for transporting and guiding the photosensitive material through the processing solution 18. The heater 80 and nozzle 46 are simply positioned within the tank 12 closely adjacent the path of the photosensitive material 20 such that the nozzle 46 will be closely adjacent for providing impingement solution against the photosensitive material 20 and the heater 80 being disposed in direct opposition to the nozzle 46 for providing heat to the photosensitive material 20 at this area.

Figure 8:
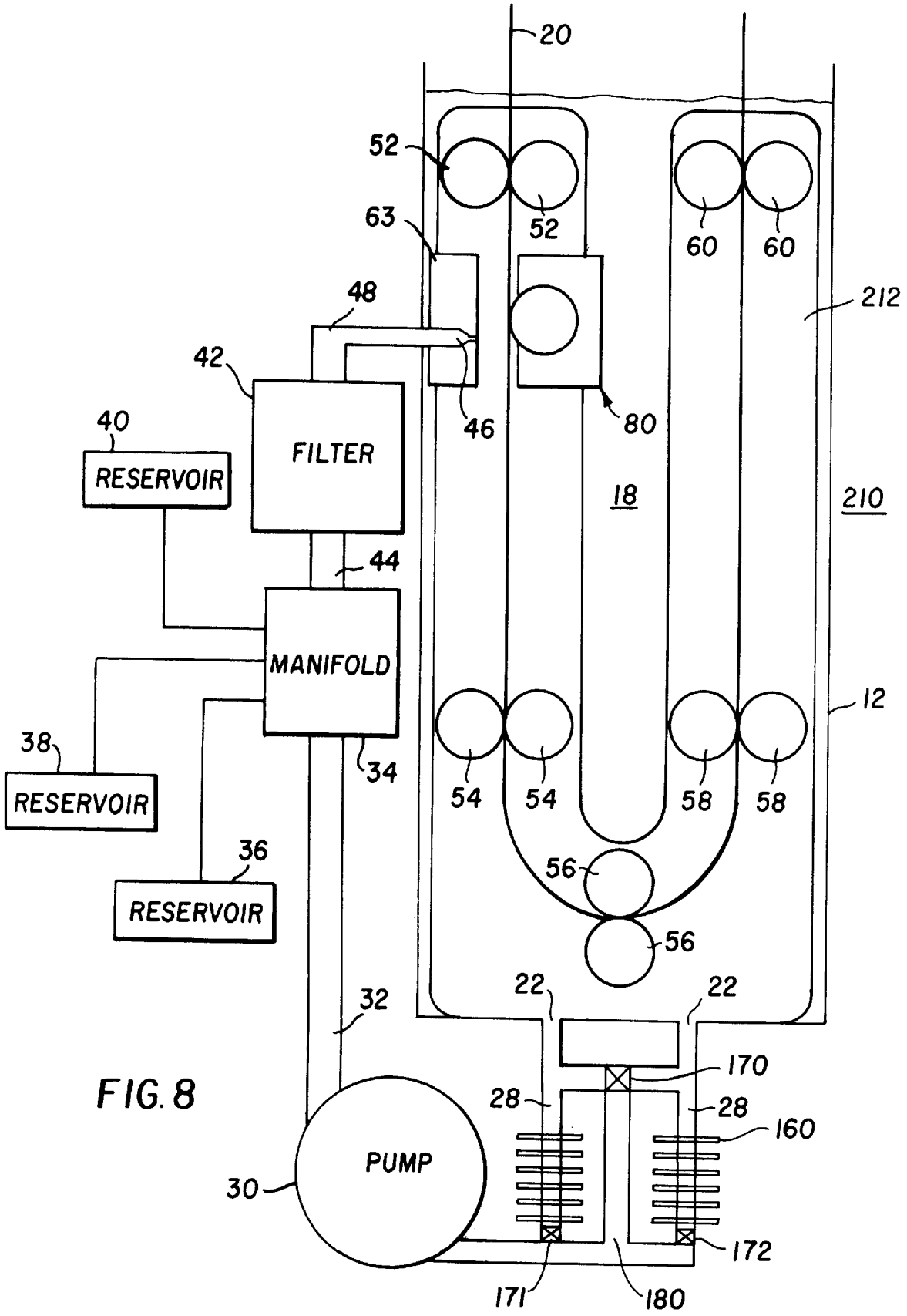
FIG. 8 is a schematic view similar to FIG. 5 illustrating yet another modified form of the apparatus made in accordance with the present invention.

Referring to FIG. 8, there is illustrated yet another modified apparatus made in accordance with the present invention, like numerals indicating like parts and operation as previously discussed. This embodiment is similar to that of FIG. 7 except that a cooling coils 160 are provided for cooling of the processing solution as it leaves the tank 12.

In the particular embodiment illustrated in FIGS. 1 and 2, the heater 80 is provided on one side of the photosensitive material. If desired, heater rollers 80 may be provided on both sides of the photosensitive material, for example, when emulsion layers are provided on both sides of the photosensitive material.

The present invention provides a processing apparatus which increases the efficiency of the processor without adversely affecting the processing solution.

The invention has been described in detail with particular reference to certain preferred embodiments thereof, but it will be understood that variations and modifications can be effected within the spirit and scope of the invention.

PARTS LIST

10 apparatus
11 processing section
12 processing tank
14 rack
16 processing channel
18 processing solution
20 photosensitive material
22 outlets
24 recirculation system
28,32 conduits
30 recirculation pump
34 manifold
36,38,40 reservoirs
42 filter
44 conduit
46 inlet nozzle
48 conduit
50 top surface
52,54,56,58,60 roller pairs
62 nozzle opening
63 insulating jacket
64 wall
80 heater
82 insulating block
92 elongated roller
94 circular cavity
95 top surface
96 back side
98 outer shell section
100 support base
102 emulsion layer
112,113,114 layers
106,107,108 layers
109,110,111 layers
112,113,114 layers
115,120,122 line
130 modified heater
134,136 surface
138 mounting body section
140 heat-conductive element
142 outer engaging surface
144 back surface
150 cooling coils
152 conduit
153 valves
154 conduit
155 section
156 valves
210 modified apparatus
212 rack

What is claimed is:

1. A photographic processor for developing a photosensitive material, comprising:

a processing tank containing a processing solution for processing of said photosensitive material;

a transport mechanism for moving of said photosensitive material through said processing solution; and a heater for localized heating of said photosensitive material as it passes through said processing solution.

2. A photographic processor according to claim 1 wherein said processing tank includes a rack for placement in said tank and forming a narrow processing channel, said photosensitive material having a support base having a top surface and a bottom surface, an emulsion layer placed on said top surface, said heater comprising a heating roller provided in said rack and being insulated from said rack, said heating roller being designed to contact the bottom surface of said base.

3. An apparatus according to claim 1 further comprising a recirculation system for recirculating the processing solution through said tank, said recirculation system including a tank outlet for allowing processing solution to exit from said tank, and a tank inlet for returning processing solution to said processing tank.

4. An apparatus according to claim 3 wherein said inlet comprises a slot nozzle disposed adjacent said photosensitive material, said slot nozzle being positioned in substantial opposition to said heating roller.

5. An apparatus according to claim 4 wherein processing solution is impinged upon said photosensitive material through said slot nozzle.

6. An apparatus according to claim 3 wherein said recirculation system includes a cooler for cooling of the processing solution.

7. An apparatus according to claim 6 further comprising valves for controlling flow of processing solution through the cooler.

8. An apparatus according to claim 1 wherein said heater is provided on both sides of said photosensitive material.

9. A photographic processor for developing photosensitive material, comprising:

a processing section having a narrow processing channel for containing a processing solution for processing of said photosensitive material;

a transport mechanism for moving of said photosensitive material through said processing solution;

recirculation system for circulating said processing solution through said processing tank, said recirculation system comprising an exit provided in said channel for allowing said processing solution to exit said processing channel and an inlet for returning processing solution to said processing channel, said inlet comprising a slot nozzle positioned so as to extend across the width of said photosensitive material being transported through said processing solution, said slot nozzle being mounted in a low thermal conducting mounting member; and a heater positioned adjacent said slot nozzle and within said low thermal conductive material for heating of said nozzle such that processing solution is heated as it passes through said slot nozzle so as to provide localized heating of the photosensitive material upon which the processing solution leaving the nozzle impinges.

10. A photographic processor according to claim 9 wherein said processing section includes a rack for placement in said section and forming said narrow processing channel, said photosensitive material having a support base having a top surface and a bottom surface, an emulsion layer placed on said top surface, said heater comprising a heating roller provided in said rack and being insulated from said rack, said heating roller being designed to contact the bottom surface of said base.

11. An apparatus according to claim 9 further comprising a recirculation system for recirculating the processing solution through said processing channel, said recirculation system including an outlet for allowing processing solution to exit from said processing channel and a tank inlet for returning processing solution to said processing channel.

12. An apparatus according to claim 11 wherein said inlet comprises a slot nozzle disposed adjacent said photosensitive material, said slot nozzle being positioned in substantial opposition to said heating roller.

13. An apparatus according to claim 12 wherein processing solution is impinged upon said photosensitive material through said slot nozzle.

14. An apparatus according to claim 11 wherein said recirculation system includes a cooler for cooling of the processing solution.

15. A photographic processor for developing a photosensitive material, comprising:

a processing section having a processing channel for containing a processing solution for processing of photosensitive material;

a rack disposed within said processing section for forming a narrow processing channel therewith;

a nozzle for introducing processing solution into said processing tank, said nozzle being mounted to said rack in a mounting member which is made of a material having a low thermal conductivity;

a recirculation system for recirculating processing solution through said processing channel and for impinging of said processing solution on the photosensitive material through said nozzle as it passes through said processing channel;

the heater is provided adjacent said slot nozzle for heating of said slot nozzle imbedded within said material having a low thermal conductivity so as to provide localized heating of the processing solution passing through said nozzle and for impingement on the photosensitive material.

16. A photographic processor according to claim 15 wherein said processing section includes a rack for placement in said section for forming said narrow processing channel, said photosensitive material having a support base having a top surface and a bottom surface, an emulsion layer placed on said top surface, said heater comprising a heating roller provided in said rack and being insulated from said rack, said heating roller being designed to contact the bottom surface of said base.

17. An apparatus according to claim 15 further comprising a recirculation system for recirculating the processing solution through said tank, said recirculation system including an outlet for allowing processing solution to exit from said processing channel and an inlet for returning processing solution to said processing channel.

18. An apparatus according to claim 17 wherein said inlet comprises a slot nozzle disposed adjacent said photosensitive material, said slot nozzle being positioned in substantial opposition to said heating roller.

19. An apparatus according to claim 18 wherein processing solution is impinged upon said photosensitive material through said slot nozzle.

20. An apparatus according to claim 17 wherein said recirculation system includes a cooler for cooling of the processing solution.

21. A method of processing a photosensitive material by passing the photosensitive material through a processing tank containing a processing solution, comprising the steps of:

moving said photosensitive material through said processing solution; and localized heating of said photosensitive material as it passes through said processing solution so as to improve the chemical activity of the emulsion layers contained on the photosensitive material.

22. A photographic processor for developing photosensitive material, comprising:

a processing tank containing processing solution for processing of said photosensitive material;

a transport mechanism for moving of said photosensitive material through said processing solution;

recirculation system for circulating said processing solution through said processing tank, said recirculation system includes an exit provided in said tank for removing processing solution therefrom and an inlet for returning processing solution to said processing tank, said inlet comprising a slot nozzle positioned so as to extend across the width of said photosensitive material being transported through said processing solution, said slot nozzle being mounted in a low thermal conducting mounting member; and a heater disposed adjacent said slot nozzle and within said low thermal conductive material for heating of said nozzle such that processing solution is heated as it passes through said slot nozzle so as to provide localized heating of the photosensitive material upon which the processing solution leaving the nozzle impinges.

23. A photographic processor according to claim 22 wherein said processing tank includes a rack for placement in said tank and forming a narrow processing channel, said photosensitive material having a support base having a top surface and a bottom surface, an emulsion layer placed on said top surface, said heater comprising a heating roller provided in said rack and being insulated from said rack, said heating roller being designed to contact the bottom surface of said base.

24. An apparatus according to claim 22 further comprising a recirculation system for recirculating the processing solution through said tank, said recirculation system including a tank outlet for allowing processing solution to exit from said tank and a tank inlet for returning processing solution to said processing tank.

25. An apparatus according to claim 24 wherein said inlet comprises a slot nozzle disposed adjacent said photosensitive material, said slot nozzle being positioned in substantial opposition to said heating roller.

26. An apparatus according to claim 25 wherein processing solution is impinged upon said photosensitive material through said slot nozzle.

27. An apparatus according to claim 23 wherein said recirculation system includes a cooler for cooling of the processing solution.

28. An apparatus according to claim 27 further comprising valves for controlling flow of processing solution through the cooler.

29. An apparatus according to claim 22 wherein said heater is provided on both sides of said photosensitive material.

* * * * *